US006675518B1

(12) United States Patent
Porteous

(10) Patent No.: US 6,675,518 B1
(45) Date of Patent: Jan. 13, 2004

(54) DENTAL X-RAY STORAGE AND RETRIEVAL SYSTEM

(75) Inventor: Don Porteous, Oxnard, CA (US)

(73) Assignee: Clive Craig Co., Oxnard, CA (US)

( * ) Notice: Subject to any disclaimer, the term of this patent is extended or adjusted under 35 U.S.C. 154(b) by 158 days.

(21) Appl. No.: 09/768,538

(22) Filed: Jan. 24, 2001

Related U.S. Application Data

(60) Provisional application No. 60/215,375, filed on Jun. 29, 2000.

(51) Int. Cl.[7] ..... A47G 1/06; G09F 3/18

(52) U.S. Cl. ..... 40/701; 40/776; 40/661.09

(58) Field of Search ..... 40/359, 361, 654.01, 40/661.09, 771, 774, 775, 776, 701; 283/109

(56) References Cited

U.S. PATENT DOCUMENTS 1,466,255 A * 8/1923 Spitzer ..... 40/776 X
2,687,590 A * 8/1954 Johnson
2,797,509 A * 7/1957 Golden ..... 40/661.09
3,464,135 A * 9/1969 Eidinger
4,510,708 A * 4/1985 Pokrinchak ..... 40/361
5,704,472 A * 1/1998 Werner et al. ..... 206/455 X
5,875,579 A * 3/1999 Winzen ..... 40/654.01 X
5,904,373 A * 5/1999 Krapf ..... 40/771 X
6,216,379 B1 * 4/2001 Tanaka ..... 40/775 X

* cited by examiner

*Primary Examiner*—Joanne Silbermann
(74) *Attorney, Agent, or Firm*—Louis J. Bachand

(57) ABSTRACT

Storage and retrieval system for dental x-ray films having an opaque panel and a clear plastic panel, the panels are joined at three sides to form a container sized and suited for safely storing the x-ray films and facilitating their retrieval through the visibility of the films in the container. One panel has a continued extent with tacky adhesive for closing the container or for holding the container on an x-ray film mount while permitting flipping up of the container to reveal x-rays beneath the container without detaching the container from the mount.

15 Claims, 3 Drawing Sheets

DENTAL X-RAY STORAGE AND RETRIEVAL SYSTEM

CROSS REFERENCE TO RELATED APPLICATIONS

This application claims the benefit of U.S. Provisional Application Serial No. 60/215,375 filed Jun. 29, 2000.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to storage and retrieval systems for dental x-rays, and to containers for use in such systems. More particularly, the invention relates to improved products for the storage of mounted dental x-rays that enable easy determination of the identity of the stored x-rays without removal of the x-rays from their storage container, positioning of, e.g., historical x-ray films on a mount of current x-ray films in an easy to use position from which the container is readily flipped up to reveal and provide access to the current x-ray films on the mount, and facilitate writing identifying or other indicia on the container in a specially provided location.

The invention is advantageous as well for being manufacturable without use of typical envelope making machinery that relies on bonding adhesives and is not adapted well to making very small envelopes with see-through portions. The invention containers use melt techniques to bond the container panels.

2. Related Art

Dental x-rays are typically held in plastic sheet mounts of approximately 5×11 inches that have x-ray film mounting slots. Typically current x-ray films are mounted in the slots. Archived or historical x-ray films needed for an appraisal of past vs. current tooth and gum conditions are kept in odd containers that lack convenience in use. Typically, these odd containers are pressed into service from another pat of the dentist's office and lack see-through ability, ease of mounting to anything anywhere, such as the x-ray film mount, and are untidy. An important consideration to the dental practitioner is ease of handling and minimizing damage to the x-ray film. The dental practitioner typically stores indefinitely the x-ray films previously used in patient diagnosis and treatment. Locating a particular x-ray after a period of time is made more difficult by the present practice of placing the x-ray film in the odd small bag similar to a coin envelope where they are concealed from view and not easy to identify or retrieve.

BRIEF SUMMARY OF THE INVENTION

It is an object of the present invention to provide an improved dental x-ray storage and retrieval system. It is a further object to provide a container tailored for storage of dental x-ray films that have been exposed and developed to retain tooth images of a patient, that have served their immediate purpose, and that are no longer associated with a patient's chart, but that must retained for future reference. A further object is to provide the container with a transparent panel for easy ascertainment of the presence or not of x-ray film within the container, and the identity of the particular x-ray film. A further object is to provide a flap portion on the containers that has a tacky adhesive enabling placing the container on the x-ray film mount for storage, the adhesive flap permitting flipping up of the container to reveal and provide access to the underlying current x-ray films, or the flap can be used to reversibly close the container. Another object is to provide a visible write able surface for recording patient or other data.

These and other objects of the invention to become apparent hereinafter are realized in a storage and retrieval system for dental x-rays comprising one or more dental x-ray films, an enclosing container sized for closely containing the dental x-ray films, the container having a first generally rectangular panel for rigidity and a second panel generally congruent with the first panel and at least partially of a transparency affording an identifying view of the x-ray films within the container, the second panel being adhered to the first panel along three sides forming a pocket close about the x-ray films in x-ray film storing and retrieving relation, the first panel defining a flap portion beyond the pocket comprising a continued extent of the first panel having tacky adhesive thereon for detachably securing the container to an X-ray mount face or other surface or alternately reversibly closing the open side of the pocket.

In this and like embodiments, typically, the first panel is opaque, and comprises cellulosic material such as paper, the second panel is transparent and comprises a transparent plastic material, such as a heat meltable, transparent plastic and is heat melted to adhere to the first panel along substantially three sides of the panels in container-defining relation and free of added adhesive.

In these and like embodiments, there is also included a peel strip temporarily covering the flap adhesive.

In a further embodiment, the invention provides, in combination, the described dental x-ray storage and retrieval system container and an x-ray film mount, the container being attached to the edge of the mount by the flap for flipping back and to the mount without detaching so as to provide a view of x-ray film mounted on the mount beneath the container.

In this and like embodiments, typically, the flap on its face opposite the adhesive defines a write able surface.

In a further embodiment the invention provides an enclosing container useful in a storage and retrieval system for one or more dental x-ray films, the container comprising a first generally rectangular cellulosic panel for rigidity and a more flexible second panel generally congruent with the first panel and comprised of a heat-meltable transparent plastic material permitting viewing of container contents, the second panel being melt-adhered to the first panel along three sides forming a pocket, the first panel defining a flap portion beyond the pocket comprising a continued extent of the first panel having tacky adhesive thereon for detachably securing the container to an X-ray mount face or other surface or alternately reversibly closing the open side of the pocket.

In this and like embodiments, generally, the first panel is opaque, the flap portion defining a write able surface opposite the adhesive, the first panel comprises paper, and includes also a peel strip on the adhesive on the flap portion.

In a further and particular embodiment, the invention provides a storage and retrieval system for dental x-rays comprising one or more dental x-ray films, an enclosing container for the dental x-ray films, the container having a first generally rectangular panel of about 3.75 inches in height and about 2.5 inches in width, with about 0.5 inch of the height taken by the flap portion of the envelope, the first panel being comprised of paper and relatively rigid and a second panel generally congruent with the first panel and comprised of a heat-meltable transparent plastic material of about 3.25 inches in height and about 2.5 inches in width such that the first panel flap portion continues about 0.5 inch above the height of the second panel. The second panel is relatively less rigid than the first panel and affords an identifying view of the x-ray films within the container, the second panel being melt-adhered to the first panel along three sides to provide a second panel open side edge for insertion and removal of x-ray films in storing and retrieving relation. Further, the second panel is free of melt adhesion to the first panel adjacent and below the open edge to permit bending back of the open edge to facilitate insertion and removal of the dental x-ray films.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 1:
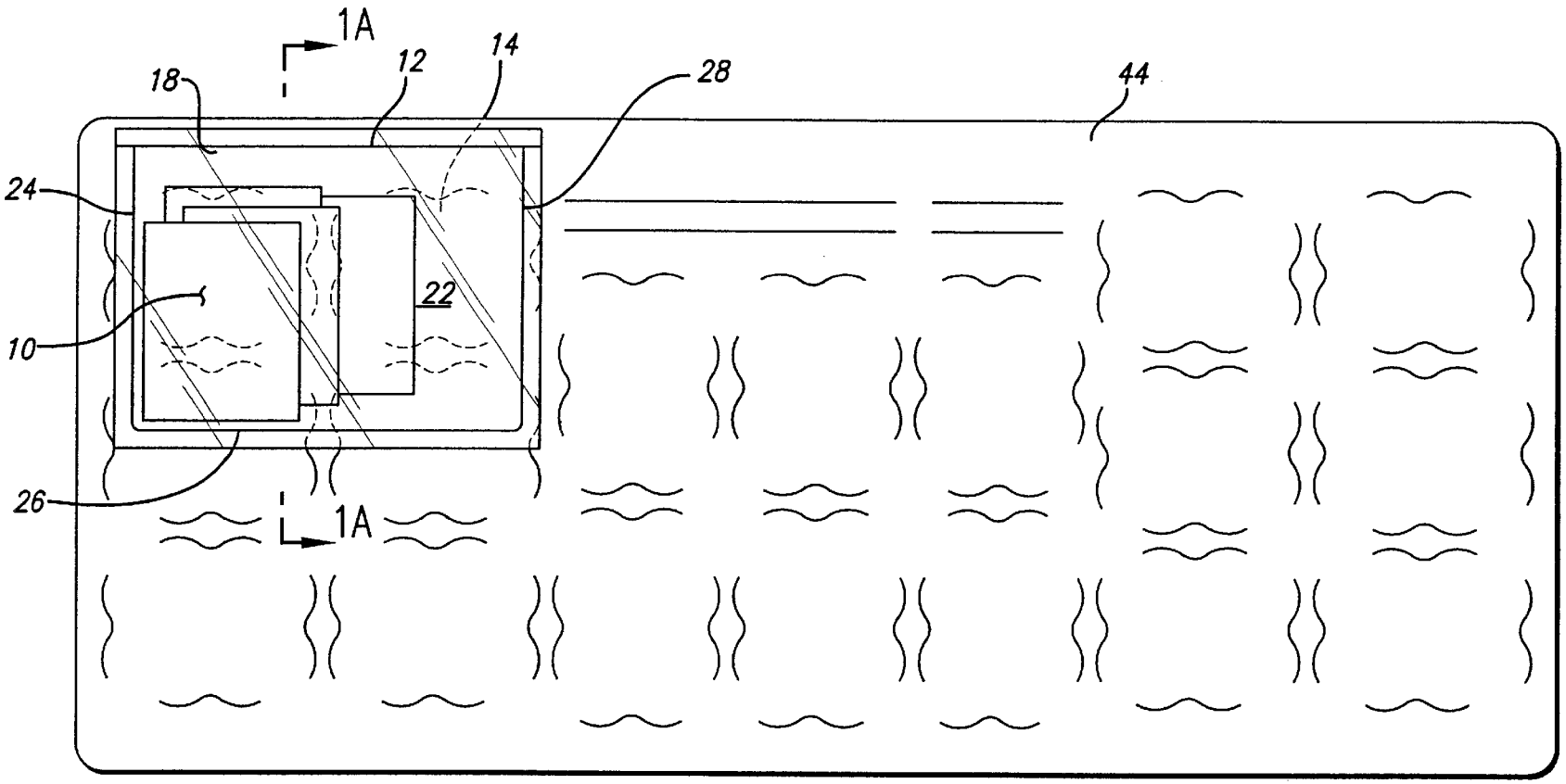
FIG. 1 is an exploded view of the assembly of the invention container with x-ray films within, and an x-ray film mount, the container being attached to the mount by the tacky adhesive on the flap portion.

The term dental x-ray film herein refers to the x-ray film itself and the x-ray film in an individual holder that can be inserted in an x-ray film mount such as shown in FIG. 1.

Figure 1A:
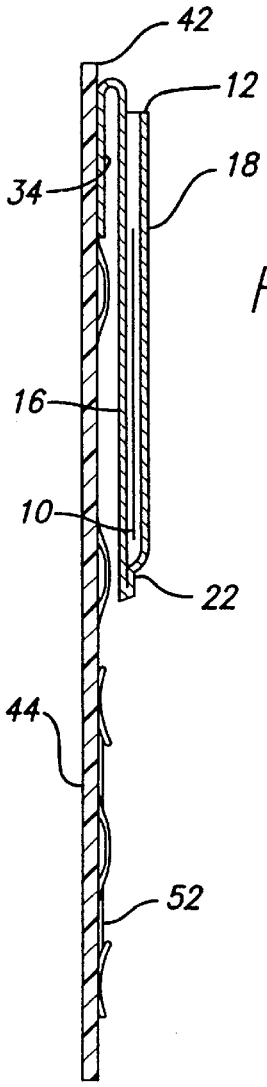
FIG. 1A is a view in section taken on line 1A—1A in FIG. 1.
Figure 4:
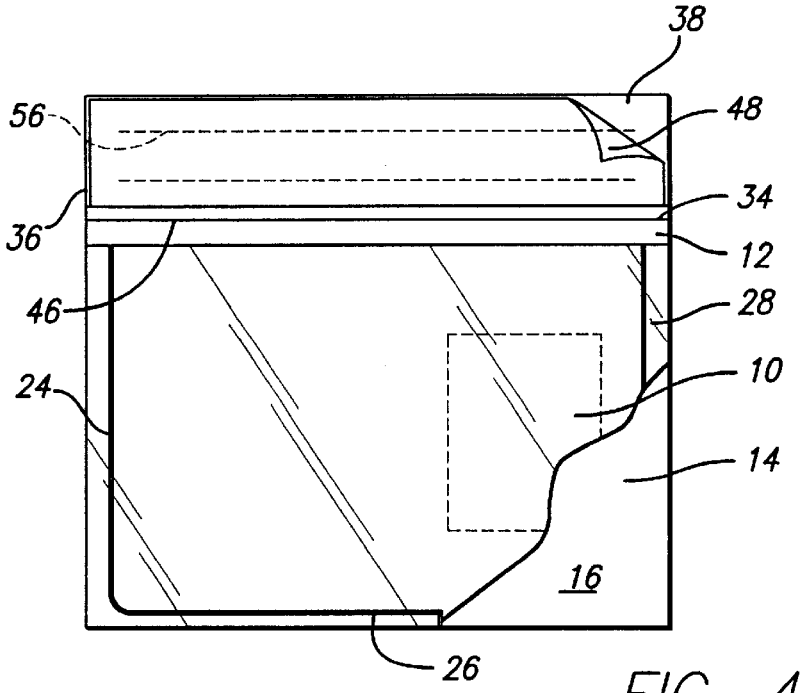
Figure 3:
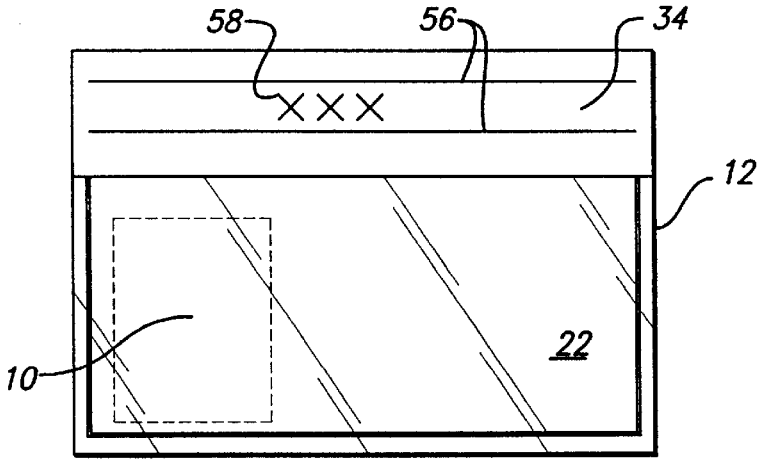
FIG. 3 is a front elevational view of the container with the flap portion closed, identifying indicia having been added to the flap portion; and, FIG. 4 is a rear elevational view of the container with the flap portion lifted up and its x-ray film content exposed.
Figure 2:
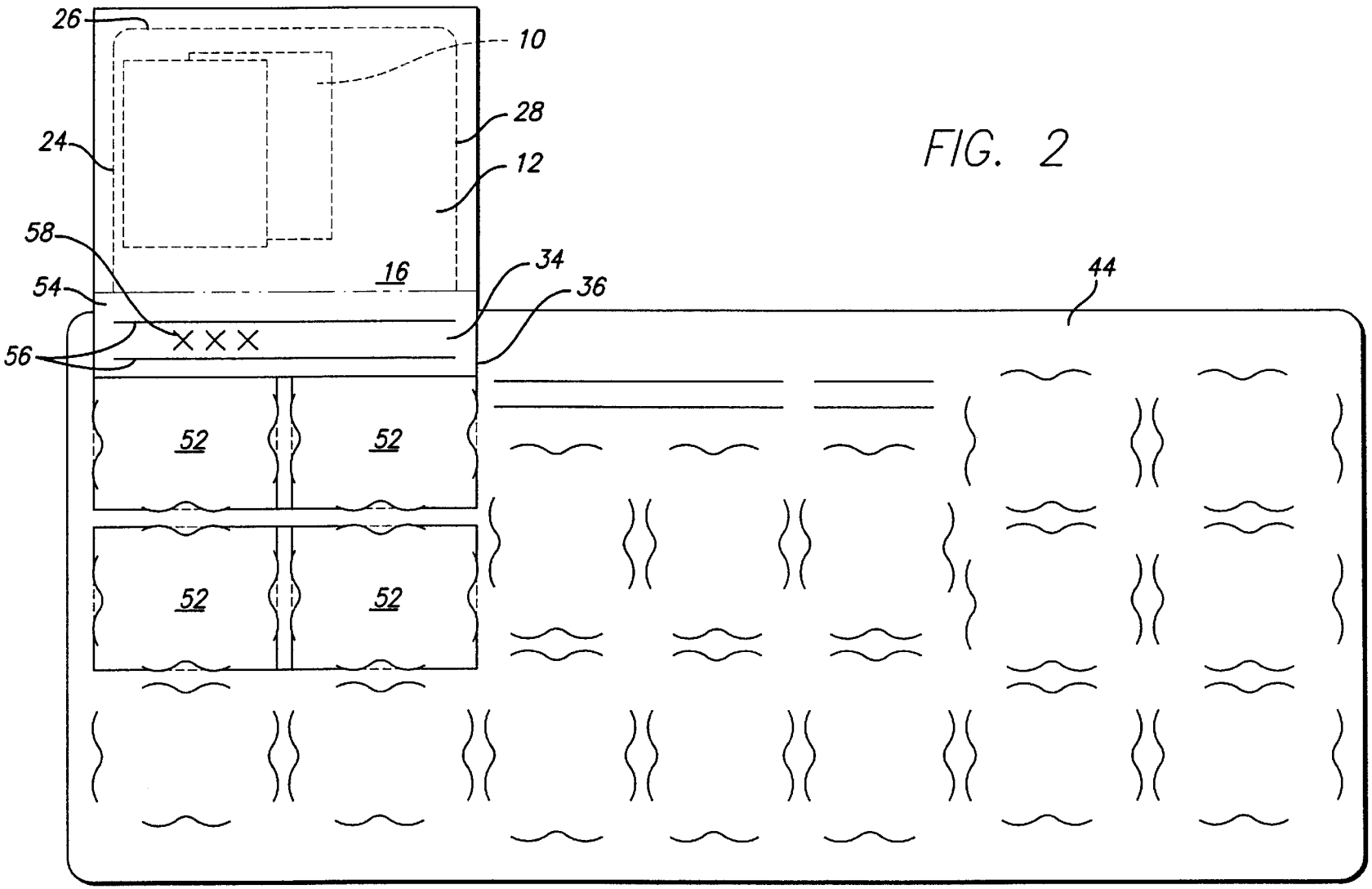
FIG. 2 is a view like FIG. 1 showing the container flipped back to expose the x-ray films on the mount, and to expose the other x-ray films in the container, the container still being adhered to the mount by its flap portion.

With reference now to the drawings in detail, in FIGS. 1–4 the storage and retrieval system for dental x-rays is shown to comprise one or more dental x-ray films 10 (FIG. 1A) within an enclosing container 12 sized for closely containing the films.

The container 12 has a first generally rectangular panel 14 that is relatively rigid cellulosic material such as paper 16, as compared with the second panel 18 of plastic film 22 cut to be generally congruent with the first panel and at least partially of a transparency affording an identifying view of the x-ray films 10 within the container.

The second panel 18 is adhered to the first panel 14 along three sides 24, 26 and 28 forming a pocket 32 close about the x-ray films 10 to store the x-ray film for safekeeping and for ready retrieval.

The first panel 14 defines a flap portion 34 beyond the pocket 32 that comprises a continued extent 36 of the first panel. Flap portion 34 has a tacky adhesive 38 thereon for detachably securing the container 12 to the face 42 of the X-ray mount 44 or other surface, such as a file cabinet face or desktop (not shown); or, alternately, reversibly closing the open side 46 of the pocket 32, see FIGS. 3 and 4.

The first panel 14 is typically opaque paper; the second panel 18 is typically a transparent plastic material, such as a heat meltable, transparent plastic such as a polyolefin, that is heat melted to adhere to the first panel along substantially the three sides 24, 26 and 28 of the panels in container-defining relation and free of added adhesive. It is advantageous to have the bonding performed by melting one panel 18 of the container 12 rather than use added adhesive since manufacturing machinery may clog or become gummed-up when adhesive is added to a locus between sheets of material being joined together at high speed.

The tacky adhesive 38 can be added during the manufacturing process and covered with a temporary peel strip 48 so as to not interfere with manufacture.

The invention storage and retrieval system container 12 is attached to the mount 44 at the upper edge of the face 42, see FIG. 1, where it can repose as shown or be flipped back to reveal the underlying x-ray film 52 while being supported by the flap portion 34 in either position and without detachment that leads to loss or misplacement of the container 12 and its contents of archival x-ray films 10. The tacky adhesive permits repeated stickings and unstickings for this purpose.

Flap portion 34 suitably comprises on its face opposite the adhesive bearing face, a write able surface 54. Lines 56 are provided to assist in the location of readable indicia 58 on the flap 34 that will identify the container contents, or the patient, or provide other data useful to the user.

A typical product according to the invention has a first generally rectangular panel 14 of about 3.75 inches in height and about 2.5 inches in width, with about 0.5 inch of the height taken by the flap portion 34 of the container, the first panel being comprised of paper and relatively rigid and a second panel 18 generally congruent with the first panel and comprised of a heat-meltable transparent plastic material of about 3.25 inches in height and about 2.5 inches in width such that the first panel flap portion continues about 0.5 inch above the height of the second panel.

The invention thus provides an improved dental x-ray storage and retrieval system including a container tailored for storage of dental x-ray films that have been exposed and developed to retain tooth images of a patient, that have served their immediate purpose, and that are no longer associated with a patient's chart, but that must retained for future reference. The container has a transparent panel for easy ascertainment of the presence or not of x-ray film within the container, and the identity of the particular x-ray film. The container has a flap portion with tacky adhesive enabling placing the container on the x-ray film mount for storage, the adhesive flap permitting flipping up of the container to reveal and provide access to the underlying current x-ray films, or the flap can be used to reversibly close the container. The opposite face of the flap provides a visible, write able surface for recording patient or other data.

The foregoing objects are thus met.

I claim:

1. Storage and retrieval system for dental x-rays comprising one or more dental x-ray films, comprising an enclosing container sized for closely containing said dental x-ray films, said container having a first generally rectangular panel with a first face and a second face and a second panel generally congruent with said first panel and at least partially of a transparency affording an identifying view of said x-ray films within said container, said second panel being adhered to said first panel first face along three sides forming a pocket close about said x-ray films in x-ray film storing and retrieving relation, said first panel defining a flap portion beyond said pocket, said flap portion being foldable toward said first panel first or second faces, said flap portion comprising a continued extent of said first panel and having tacky adhesive thereon on said first panel first face for detachably securing said container to an X-ray mount face or other surface when said flap portion is folded to said first panel second face and said adhesive thereon faces outwardly, and when said flap portion is folded to said first panel first face for reversibly closing the open side of said pocket by adhesive engagement with said second panel.

2. The dental x-ray storage and retrieval system according to claim 1, in which said first panel is opaque.

3. The dental x-ray storage and retrieval system according to claim 1, in which said first panel comprises cellulosic material.

4. The dental x-ray storage and retrieval system according to claim 3, in which said first panel comprises paper.

5. The dental x-ray storage and retrieval system according to claim 1, in which said second panel is transparent.

6. The dental x-ray storage and retrieval system according to claim 1, in which said second panel comprises a transparent plastic material.

7. The dental x-ray storage and retrieval system according to claim 1, in which said second panel comprises a heat meltable, transparent plastic and is heat melted to adhere to said first panel along substantially three sides of said panels in container-defining relation.

8. The dental x-ray storage and retrieval system according to claim 1, including also a peel strip temporarily covering said flap adhesive.

9. In combination, the dental x-ray storage and retrieval system container according to claim 1 and an x-ray film mount, said container being attached to the edge of said mount by said flap portion for flipping back and to said mount without detaching so as to provide a view of x-ray film mounted on said mount beneath said container.

10. The dental x-ray storage and retrieval system according to claim 1, in which said flap portion on said first panel second face defines a write able surface.

11. The enclosing container according to claim 10, in which said first panel comprises paper, and including also a peel strip on said adhesive on said flap portion.

12. Storage and retrieval system for dental x-rays comprising one or more dental x-ray films according to claim 1, said container panel being about 3.5 inches in length and about 3 inches in width, said first panel being comprised of paper and relatively rigid and having a first face and a second face, said second panel being generally congruent with said first panel and comprised of a heat-meltable transparent plastic material of about 3.5 inches in length and about 2.5 inches in width, said second panel being relatively less rigid than said first panel and affording an identifying view of said x-ray films within said enclosure, said second panel being melt-adhered to said first panel first face along three sides to provide an open edge for insertion and removal of x-ray films in storing and retrieving relation.

13. Storage and retrieval system for dental x-ray films according to claim 12, in which said second panel is free of melt adhesion to said first panel adjacent and below said open edge to permit bending back of said open edge to facilitate insertion and removal of said dental x-ray films.

14. An enclosing container useful in a storage and retrieval system for one or more dental x-ray films, said container comprising a first generally rectangular cellulosic panel having a first face and a second face and a second panel comprised of a heat-meltable transparent plastic material permitting viewing of container contents, said second panel being melt-adhered to said first panel first face along three sides forming a pocket, said first panel comprising a one-piece web having a continued extent defining a foldable flap portion beyond said pocket, said flap portion having tacky adhesive thereon on said first panel first face for detachably securing said container to an X-ray mount face or other surface when folded away from said first panel first face and reversibly closing the open side of said pocket when folded toward said first panel first face.

15. The enclosing container according to claim 14, in which said first panel is opaque, said flap portion defining a write able surface on said first panel second face.

* * * * *